US011878776B1

(12) United States Patent
Haynes

(10) Patent No.: US 11,878,776 B1
(45) Date of Patent: Jan. 23, 2024

(54) KAYAK MOTOR AND MOTOR MOUNTING APPARATUS

(71) Applicant: Randall G. Haynes, Wright City, MO (US)

(72) Inventor: Randall G. Haynes, Wright City, MO (US)

( * ) Notice: Subject to any disclaimer, the term of this patent is extended or adjusted under 35 U.S.C. 154(b) by 0 days.

(21) Appl. No.: 17/980,368

(22) Filed: Nov. 3, 2022

Related U.S. Application Data

(60) Provisional application No. 63/370,082, filed on Aug. 1, 2022.

(51) Int. Cl.
*B63B 34/26* (2020.01)
*B63H 20/06* (2006.01)

(52) U.S. Cl.
CPC ..... *B63B 34/26* (2020.02); *B63H 20/06* (2013.01)

(58) Field of Classification Search
CPC ..... B63B 34/26; B63H 20/06
See application file for complete search history.

(56) References Cited

U.S. PATENT DOCUMENTS 1,118,208 A * 11/1914 McLaren ..... B63H 20/06 248/641
2,138,600 A * 11/1938 Harmon ..... B63H 20/08 248/641
3,601,344 A 8/1971 Nourse
4,746,311 A * 5/1988 Kraus ..... B63H 20/007 74/480 B
5,679,036 A 10/1997 Crawley
7,887,381 B2 2/2011 Brass
8,276,536 B2 10/2012 Winsky
8,408,955 B2 4/2013 Boebel
8,516,973 B1 8/2013 Hamilton
8,753,156 B2 6/2014 Ketterman
9,248,897 B2 2/2016 Shields
9,290,251 B1 * 3/2016 Schmidtke ..... B63H 20/06
10,124,873 B2 11/2018 Aguirre
11,180,226 B2 11/2021 Jensen
11,247,764 B2 2/2022 Lammers-Meis
2009/0042461 A1 2/2009 Walton
2015/0336649 A1 11/2015 Radenbaugh
2021/0229780 A1 7/2021 Becker
2022/0219797 A1 7/2022 Zhou
2022/0227464 A1 7/2022 Mogrovics

* cited by examiner

*Primary Examiner* — Stephen P Avila
(74) *Attorney, Agent, or Firm* — PatentPC PowerPatent; Bao Tran

(57) ABSTRACT

The present invention is a motor and motor mounting system for kayaks and other watercraft. The mounting system uses a set of mounting plates and a mounting knuckle that are can be attached directly to a wide variety of kayak stern shapes. The mounting system further utilizes a unique slot system along with a pivoting bracket to keep the motor in line with the direction of travel when lowered or upright and out of the water when raised. The present invention is further comprised of a motor to propel the kayak and a motor controller system allowing user control.

15 Claims, 11 Drawing Sheets

KAYAK MOTOR AND MOTOR MOUNTING APPARATUS

FIELD OF THE INVENTION

The present invention relates generally to watercraft propulsion. More specifically, the present invention is a motor and motor mounting apparatus for kayaks and other watercraft.

BACKGROUND OF THE INVENTION

Kayaks and other watercraft often have a tapered sterns to minimize hydrodynamic drag and help cut through the water. Typically, these crafts also have a shallow draft which allows them to float in shallow water. Further, there is a wide range of unique stern shapes that vary by brand, size, and other factors.

These properties make mounting a motor system to a kayak or watercraft difficult. Current motor mounts rely on clamping or mounting a motor to a flat surface or a specialty mounting area. Some motor mounts have attempted to fix the problem with motor mounts that are bulky, obtrusive, non-aerodynamic, and difficult to utilize. Further, these motor mounts are typically just means for mounting a conventional electric or gasoline outboard motor. Further attempts to create a kayak motor mount required substantial modification, drilling, or cutting.

At the present time, no motor and motor mounting system exists which allows a kayak or watercraft user to further utilize their kayak or watercraft without the drag and handling issues associated with an appendage extending into the water.

Therefore, there is a need for a motor and motor mounting system that can be mounted to the stern of a wide variety of kayaks and watercraft, easily and without significant modification. Further, there is a need for a system which allows a user to quickly engage and utilize the motor, and then be able to disengage and stow the motor in a manner that provides little or no drag and no changes to the handling of the kayak or watercraft.

SUMMARY OF THE INVENTION

The present invention relates to an apparatus which mounts directly to the stern of a kayak or watercraft and a motor which propels the kayak or watercraft. The present invention is comprised of a motor assembly, pivoting bracket, mounting knuckle, and a set of mounting plates.

The mounting plates being affixed or mounted directly to the stern surface of the kayak or watercraft. The mounting plates are connected to the mounting knuckle to provide a solid base or mount for the present invention. The pivoting bracket is pivotally connected to the mounting knuckle and the motor assembly is rotatably connected to the pivoting bracket.

The pivoting bracket is further comprised of a unique set of slots which allow the motor assembly to be in line with the direction of travel when lowered or in an upright position when raised. The motor assembly is buoyant so when not in use, the motor will automatically raise and lower drag, yet when activated, the motor assembly will automatically lower into the proper position. Further, the motor assembly can be fully raised out of the water with the use of a lift cord or other means.

The unique mounting system along with the adjustable features, allows the present invention to be mounted and adjusted to fit a wide variety of kayaks and watercraft. Further, the raising and lowering functions of the system reduces drag, maintains the handling capabilities of the kayak or watercraft, and allows the kayak or watercraft to operate in shallow water.

DETAIL DESCRIPTIONS OF THE INVENTION

Figure 1:
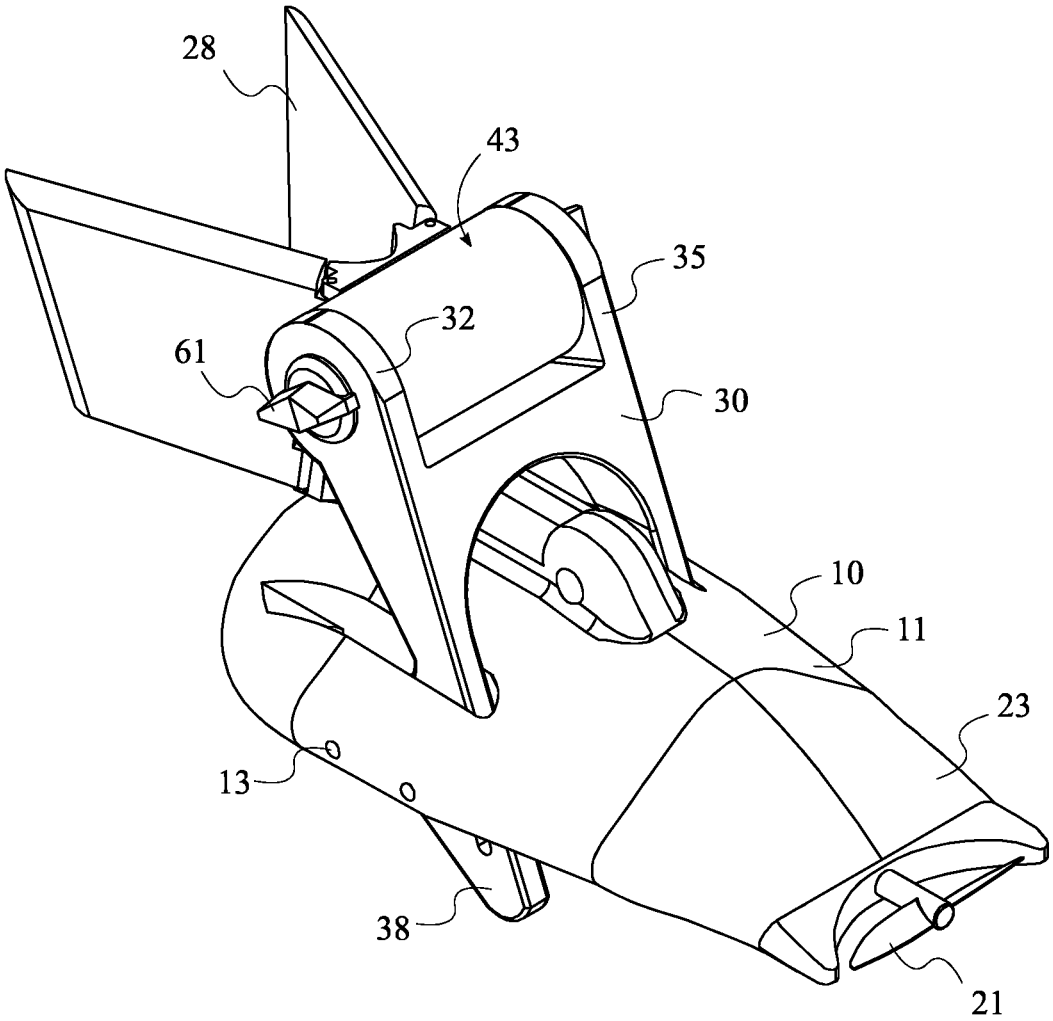
FIG. 1 shows a left top prospective view of a preferred embodiment of the present invention.
Figure 2:
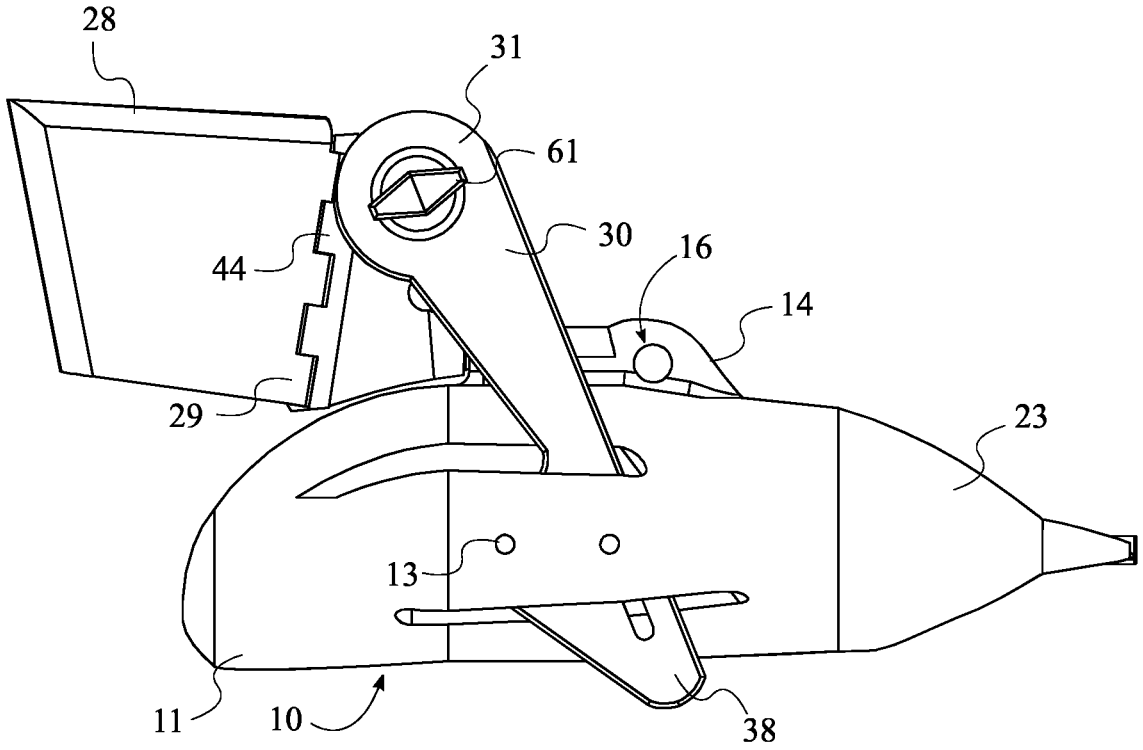
FIG. 2 shows a left elevation view of a preferred embodiment of the present invention.
Figure 3:
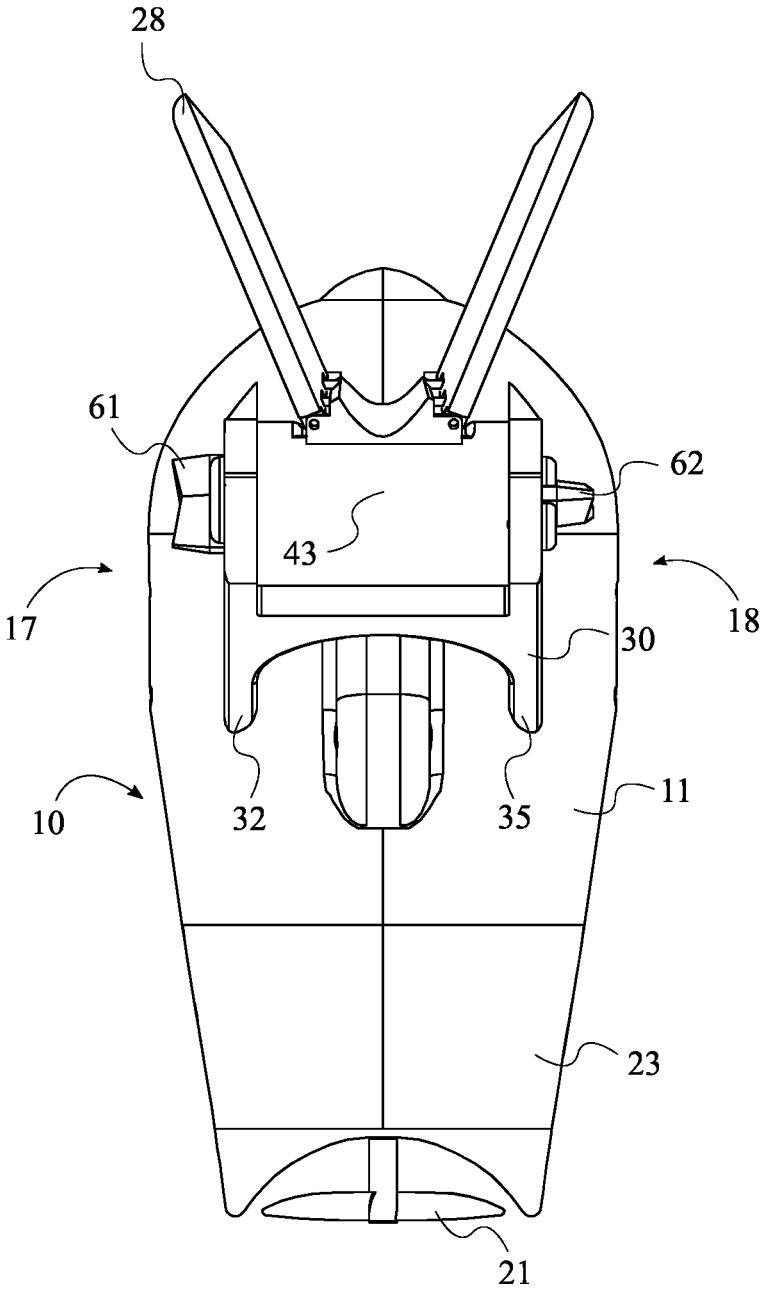
FIG. 3 shows a top plan view of a preferred embodiment of the present invention.
Figure 4:
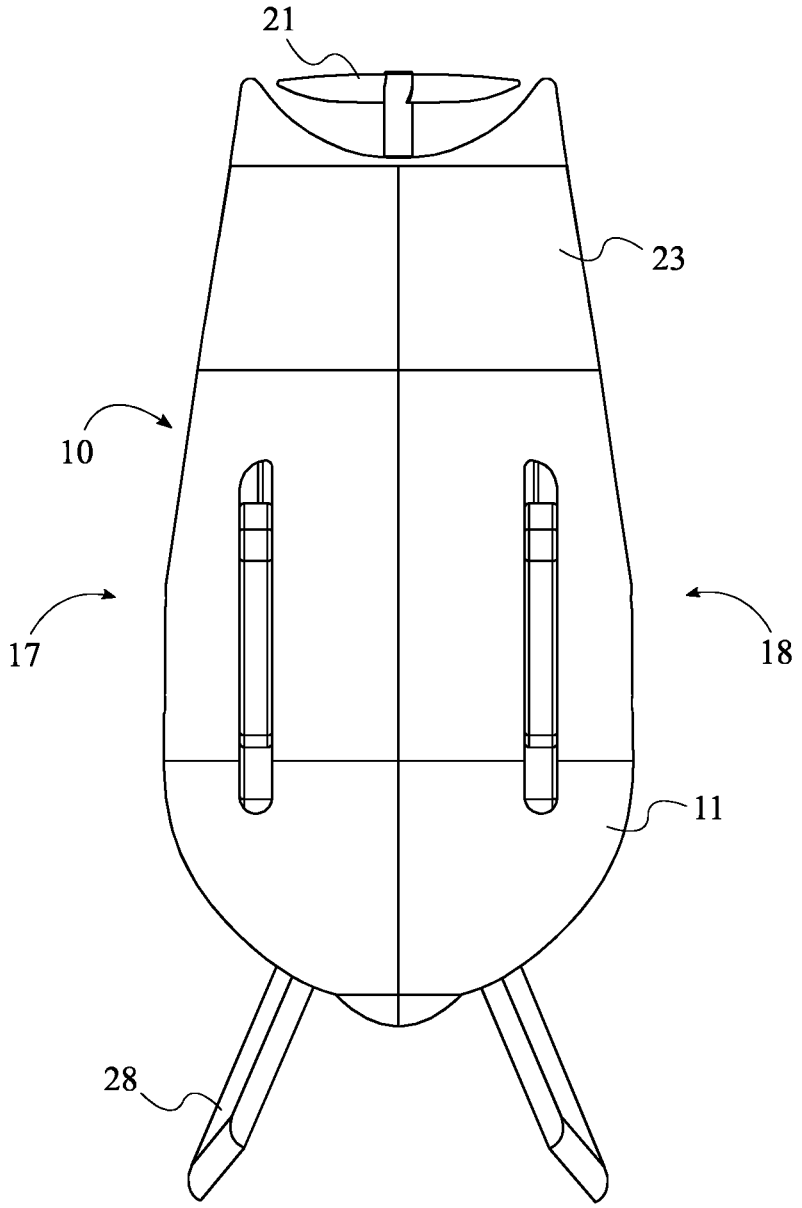
FIG. 4 shows a bottom plan view of a preferred embodiment of the present invention.
Figure 5:
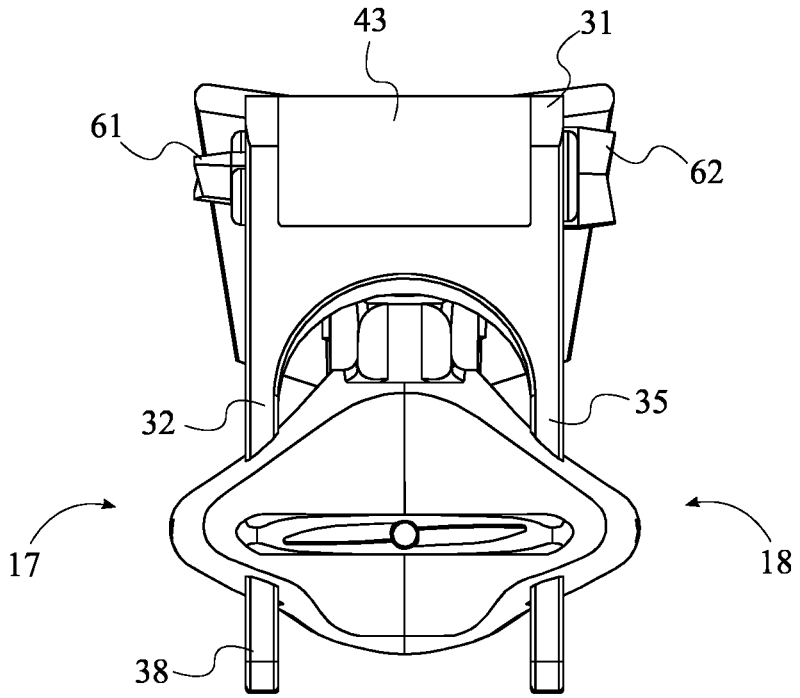
FIG. 5 shows a front elevation view of a preferred embodiment of the present invention.
Figure 6:
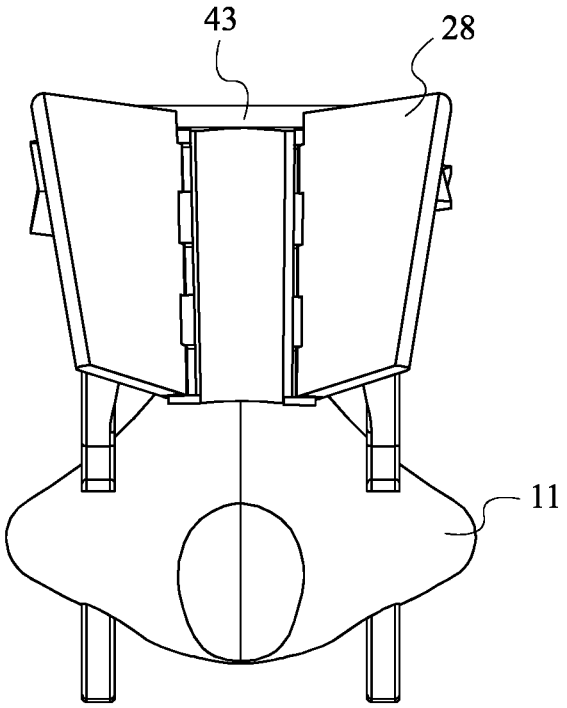
FIG. 6 shows a rear elevation view of a preferred embodiment of the present invention.
Figure 7:
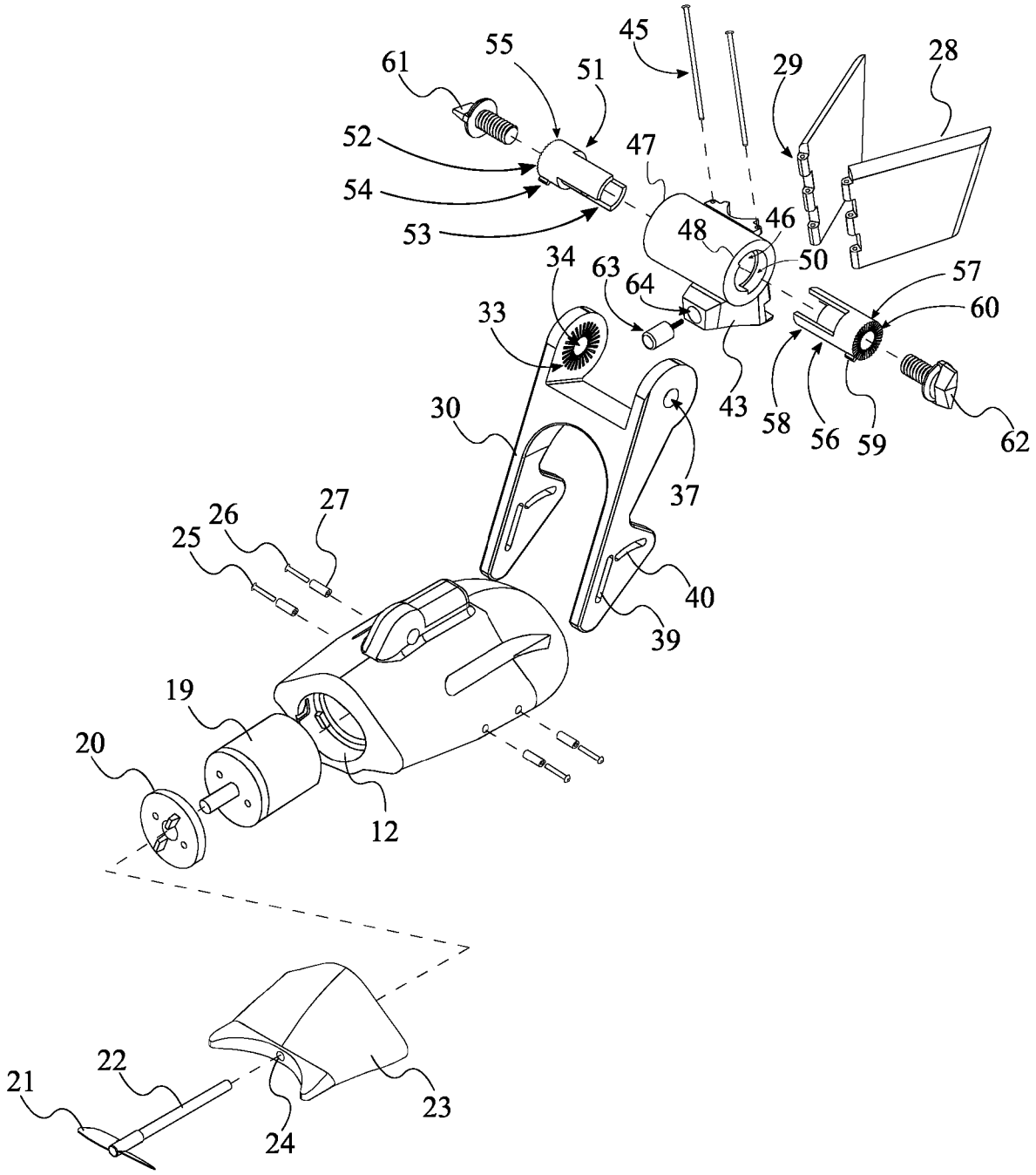
FIG. 7 shows an exploded view of the preferred embodiment of the present invention.
Figure 8:
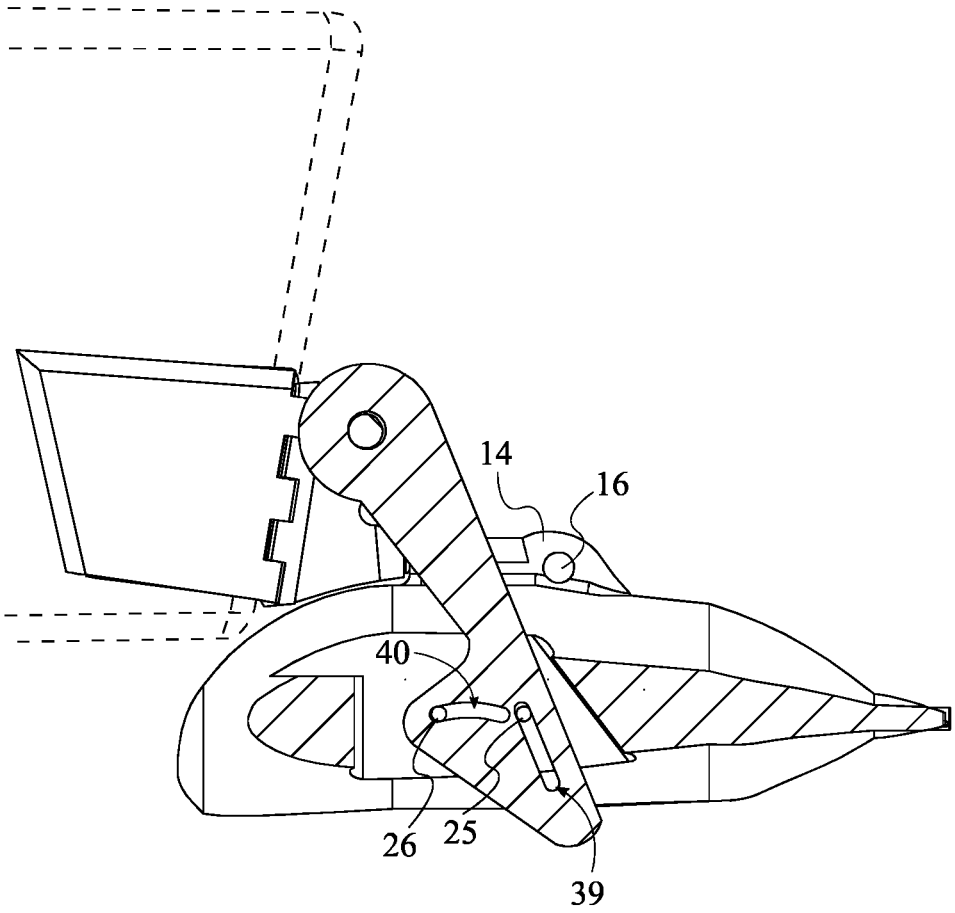
FIG. 8 shows a cross section view with the preferred embodiment in the deep water position.
Figure 9:
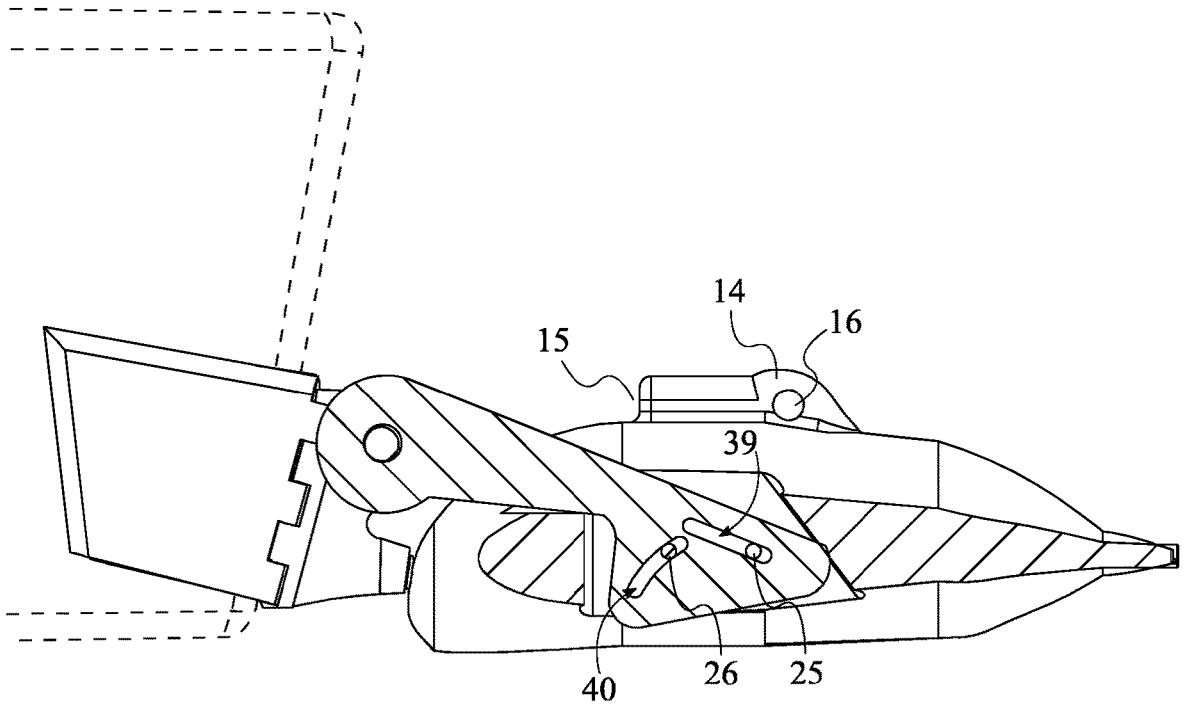
FIG. 9 shows a cross section view with the preferred embodiment in the shallow water position.
Figure 10:
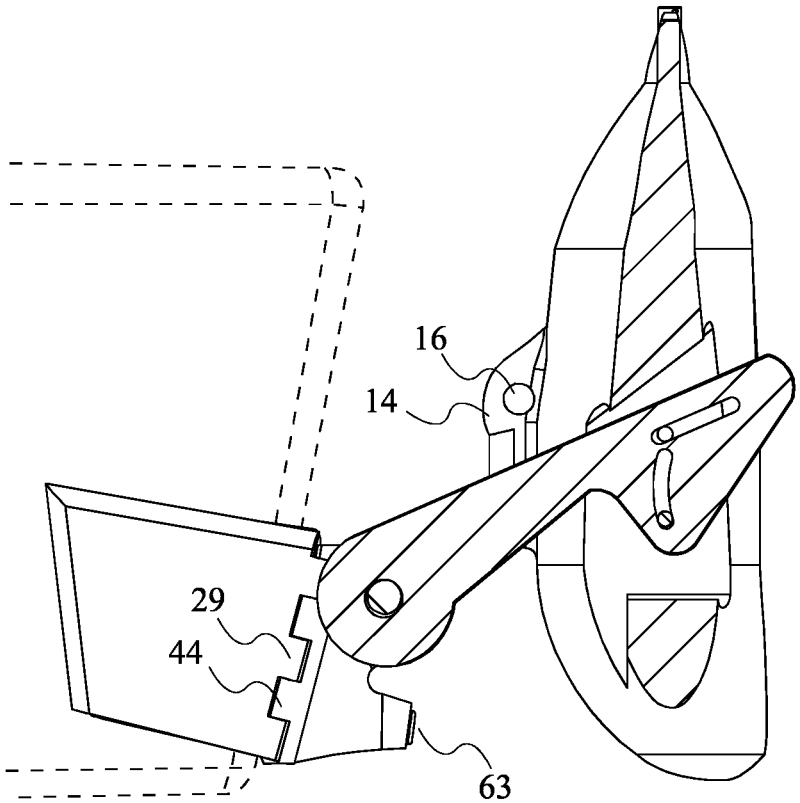
FIG. 10 shows a cross section view with the preferred embodiment in the upright position.
Figure 11:
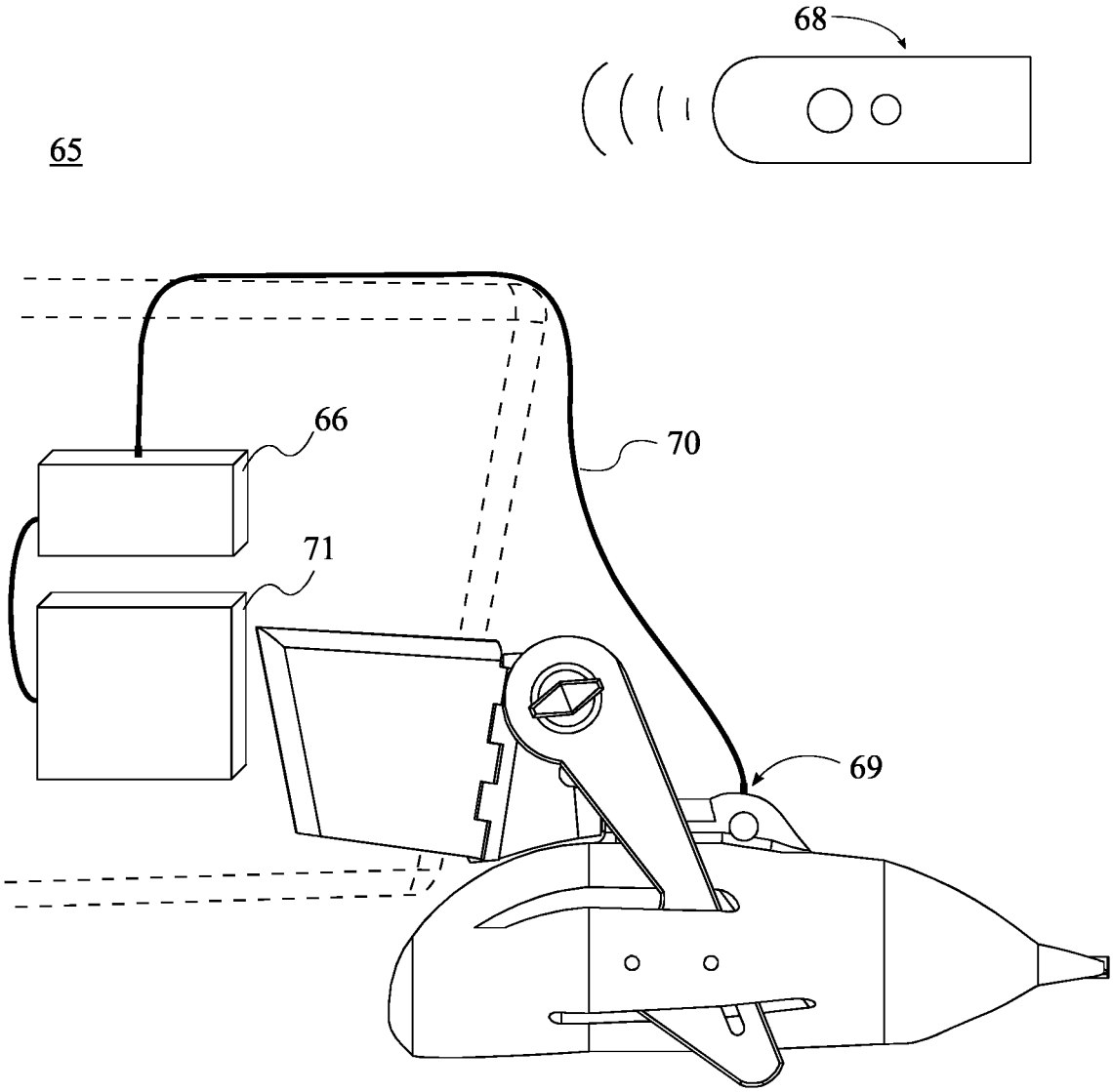
FIG. 11 shows the motor controller system of the preferred embodiment.

All illustrations of the drawings are for the purpose of describing selected versions of the present invention and are not intended to limit the scope of the present invention.

The present invention is a kayak motor and motor mounting apparatus. In the preferred embodiment the present invention comprises a motor assembly 10, a set of mounting plates 28, one or more pivoting brackets 30, a mounting knuckle 43, and a motor controller system 65.

The motor assembly 10 of the present invention provides the propulsion or the thrust, which propels the kayak or watercraft. In a preferred embodiment of the present invention, the motor assembly 10 further comprises: a housing body 11, a motor 19, a propeller 21, and an end cap 23.

The housing body 11 of the preferred embodiment encases and protects the components of the motor assembly 10. The housing body 11 has an aerodynamic shape which reduces hydrodynamic drag. The motor 19 being any suitable means of propulsion. In the preferred embodiment, the motor 19 is an electric motor.

The housing body 11 is further comprised of a motor cavity 12. The motor cavity 12 is a cavity or opening within the housing body 11 that is shaped to mount and hold the motor 19 in the proper position and orientation.

In some embodiments the motor 19 is mounted directly to the motor cavity 12 by attachment means such as fasteners or adhesives. In further embodiments, the motor 19 is held by a tight or friction fit within the motor cavity 12. The motor cavity 12 in these embodiments may be further comprised of a motor plate 20 which is threaded, twist locked, or attached with other means to motor cavity 12. In even further embodiments, the motor 19 may be attached to the motor plate 20 through means such as a fastener or adhesives. In the preferred embodiment, the motor 19 is fastened to the motor plate 20 using fasteners. The motor plate 20 is then twist locked into the end of the motor cavity 12, with motor 19 being further supported by the motor cavity 12.

The propeller 21 being a means for converting rotational motions into a linear force that propels the present invention. In the preferred embodiment, the propeller 21 is a dual bladed propeller 21 having an aerodynamic shape to reduce drag when the motor 19 is not activated. The propeller 21 is further comprised of a propeller shaft 22. The propeller shaft 22 being connected to the motor 19. The propeller shaft 22 transfers rotational motion from the motor 19 to the propeller 21.

The end cap 23 of the present invention mates and seals the end of the housing body 11. The end cap 23 further serves to enclose and create a waterproof seal for the motor cavity 12. The end cap 23 is further comprised of a propeller shaft aperture 24, which is a hole or opening that allows the propeller shaft 22 to travel through the propeller shaft aperture 24 and connect between the motor 19 which is mounted inside of the housing body 11 and the propeller 21 which is positioned outside of the housing body 11.

In the preferred embodiment the end cap 23 has an aerodynamic shape which further reduces hydrodynamic drag. The end cap 23 engages or mates with the housing body 11 to enclose and seal the housing body 11 and motor cavity 12. In the preferred embodiment, the end cap 23 is solvent welded or attached by adhesive to create a strong waterproof seal. Further embodiments may utilize other means such as O-rings, gaskets, or frictional fits. In the preferred embodiment, the propeller shaft 22 and the propeller shaft aperture 24 utilize O-rings to create a waterproof seal. Further embodiments may utilize other means to seal the propeller shaft aperture 24 such shaft seals.

The density of the motor assembly 10 in the preferred embodiment is a comparison of the weight of the motor assembly 10 divided by the volume of water that the motor assembly 10 displaces. In the preferred embodiment, the density of the motor assembly 10 should be less than the density of water, the density of water being 1 gram per milliliter. In other words, the motor assembly 10 should be buoyant. In further embodiments, the present invention may be designed for other types of water such as salt or brackish and therefore in those embodiments the density of water changes accordingly.

The mounting plates 28 of the present invention are attached or mounted to the kayak or watercraft, providing a solid attachment point on the kayak or watercraft. In a preferred embodiment of the present invention, two mounting plates 28 are attached to the stern of the kayak, one on either side of the stern. The two mounting plates 28 are mounted adjacent to the stern end of the kayak, so both mounting plates 28 maybe attached to the rest of the present invention. The shape of the mounting plates 28 can vary, but in the preferred embodiment, the mounting plates 28 are trapezoidal with rounded or filleted edges to further reduce hydrodynamic drag. The mounting plates 28 are shaped to follow the contour of the kayak stern and when mounted have a substantially continuous contact between the surfaces of the stern and the mounting plates 28.

The mounting plates 28 may be attached or mounted to the kayak or watercraft utilizing any suitable means of attachment such as fasteners, bolts, or adhesives. In a preferred embodiment, the mounting plates 28 are attached through solvent welding the mounting plates 28 to the stern of the kayak.

The pivoting brackets 30 of the present invention connect the motor assembly 10 to the mounting knuckle 43. The pivoting brackets 30 control the orientation of the motor assembly 10 in different positions. In the upright position, the motor assembly 10 is held in a vertical orientation. While in a running position, the motor assembly 10 is held in a horizontal orientation. In some embodiments, two or more independent pivoting brackets may be used to perform the functions of the pivoting brackets 30. In the preferred embodiment of the present invention, there is a single pivoting bracket 30 which is comprised of two interconnected arms, a first arm 32 and a second arm 35. The first arm 32 and second arm 35 are connected and incorporated into a single component which is the pivoting bracket 30. The pivoting bracket 30 and thereby each of the first arm 32 and the second arm 35, have an upper end 31 and a lower end 38.

The upper end 31 of the pivoting brackets 30 is pivotably connected to the mounting knuckle 43, allowing the pivoting brackets 30 to pivot upwards and downwards about the mounting knuckle 43.

The lower end 38 of the pivoting brackets 30 is further comprised of one or more straight slots 39 and one or more curved slots 40. The straight slots 39 being slots or elongated openings which extend in a substantially straight manner. The curved slots 40 being slots or elongated openings which have a shape that follows a curve or a radius.

In the preferred embodiment, the pivoting bracket 30 being pivotably connected to the mounting knuckle 43 creates a bracket radius as it rotates about the mounting knuckle 43. The curved slot radius or the radius that the curved slot 40 shape follows, when compared to the bracket radius is inverted.

In the preferred embodiment, the lower end 38 of the first arm 32 of the pivoting bracket 30 is comprised with a straight slot 39 and a curved slot 40. Further, the lower end 38 of the second arm 35 is also comprised with a straight slot 39 and a curved slot 40. The straight slots 39 and curved slots 40 on each of the first arm 32 and the second arm being a mirrored pattern about the center axis of the pivoting bracket 30.

The housing body 11 is further comprised of pin apertures 13, a first number of pins 25, a second number of pins 26, and bushings 27. The housing body 11 is rotatably connected to the lower end 38 of the pivoting brackets 30. In the preferred embodiment, the lower end 38 of the first arm 32 of the pivoting bracket 30 is positioned on a first side 17 of the housing body 11, the second arm 35 is positioned on the second side 18 of the housing body 11. In the preferred embodiment, the pin apertures 13 are arranged along both sides of the housing body 11. Each pin aperture 13 is designed to receive and hold a pin with a bushing 27. The pin apertures 13 are arranged in a manner to line up with the straight slots 39 and curved slots 40 of the lower end 38 of the pivoting bracket 30.

In the preferred embodiment, the first number of pins 25 are arranged each with a bushing 27 and then inserted through the straight slots 39 and into the pin apertures 13 on each the first side 17 and the second side 18 of the housing body 11. This creates a slidable connection between the housing body 11 and pivoting bracket 30 along the straight slots 39.

Further, in the preferred embodiment, the second number of pins 26 are arranged each with a bushing 27 and then inserted through the curved slots 40 and into the pin apertures 13 on each the first side 17 and the second side 18 of the housing body 11. This creates a slidable connection between the housing body 11 and the pivoting bracket 30 along the curved slots 40.

The mounting knuckle 43 of the present invention is a central component in the mounting function of the present invention. The mounting knuckle 43 connects to the mounting plates 28 and further provides a solid base or attachment point. Further, the mounting knuckle 43 connects to the pivoting brackets 30 and may be adjusted to control the position and range of motion of the pivoting brackets 30.

In a preferred embodiment of the present invention, the mounting knuckle 43 further comprises a set of knuckle hinges 44 and a set of hinge pins 45. The knuckle hinges 44 being one half of a hinge set, having slots to accept the corresponding other half of the hinge. The knuckle hinges 44 being integrated into the shape or body of the mounting knuckle 43. In the preferred embodiment, the mounting plates 28 further comprise a set of mounting plate hinges 29. The mounting plate hinges 29 being one half of a hinge set, having slots to accept the corresponding other half of the hinge. Each mounting plate 28 having one mounting plate hinge 29 that is integrated into shape or body of the mounting plate 28. In the preferred embodiment, the knuckle hinges 44 are pivotably connected to the mounting plate hinges 29 by integrating or mating their corresponding slots. The knuckle hinges 44 and the mounting plate hinges 29 are then removably connected via a hinge pin 45.

This hinged connection creates a pivotal connection between the mounting knuckle 43 and the mounting plates 28. This pivotal connection allows a great degree of freedom and a wide range of motion when mounting the mounting plates 28. The present invention is unique in that the present invention is able to be mounted to a wide range of kayaks with their varied stern shapes.

In the preferred embodiment, the hinge pins 45 are easy to remove and install. This allows a user to quickly and conveniently attach or remove the mounting knuckle 43, pivot brackets 30, and motor assembly 10 from the kayak or watercraft by simply adding or removing the hinge pins 45.

In further embodiments, the mounting plates 28 may be connected to the mounting knuckle 43 using other suitable means for a pivotal connection, such as hinges, bolts, or locking engagements. In yet further embodiments, the mounting plates 28 and the mounting knuckle 43 may be rigidly connected using means such as a rigid structure or being molded of a single piece.

The upper end 31 of the one or more pivoting brackets 30 are pivotally connected to the mounting knuckle 43. This pivotal connection allows the pivoting brackets 30 to pivot upward and downward, so the pivoting brackets 30 are capable of rising or lowering the motor assembly 10.

In the preferred embodiment, the mounting knuckle 43 is further comprised of a mounting bore 46, a first insert 51, and a second insert 56. The mounting bore 46 is a bore or channel that runs horizontally through the mounting knuckle 43 and creates the pivot axis used when pivotally connecting the pivoting brackets 30. The mounting bore 46 has a first side 47 and a second side 48. The first insert 51 and the second insert 56 each have a female thread end and an interlocking end.

In the preferred embodiment, the interlocking end 53 of the first insert 51 is inserted into the first side 47 of the mounting bore 46. The interlocking end 58 of the second insert 56 is inserted into the second side 48 of the mounting bore 46. The interlocking end 53 of the first insert 51 and the interlocking end 58 of the second insert 56 connect and mate within the mounting bore 46, creating a connection that locks the first insert 51 and second insert 56 together so they cannot rotate independently. In further embodiments, the present invention may use other versions or means for such a solid insert instead of two independent inserts, integrally molded or attached inserts, or a mounting knuckle 43 without an insert yet still containing the features of the first and second insert.

In the preferred embodiment, the mounting bore 46 is further comprised of a first guide channel 49 and a second guide channel 50. The first guide channel 49 being a channel or groove that extends around a partial circumference of the mounting bore 46 adjacent to the first side 47. In the same manner, the second guide channel 50 extends around a partial circumference of the mounting bore 46 adjacent to the second side 48.

In the preferred embodiment, the first insert 51 is further comprised of a first protrusion 54 and the second insert 56 is further comprised of a second protrusion 59. The first protrusion 54 of the first insert 51 is positioned within and travels within the first guide channel 49. In the same manner, the second protrusion 59 of the second insert 56 is positioned within and travels within the second guide channel 50. Thereby, the rotational range of motion or travel of the first insert 51 within the mounting bore 46 is constrained or controlled by the range of travel of the first protrusion 54 within the first guide channel 49. In the same manner, the rotational travel of the second insert 56 is constrained by the range of travel of the second protrusion 59 within the second guide channel 50.

The first insert 51 is further comprised of a number of first insert serrations 55 and the second insert 56 is further comprised of a number of second insert serrations 60. In the preferred embodiment the insert serrations are a set of indentations or notches located on the face of the female thread end 52 of the first insert 51 and the second insert 56. In the preferred embodiment, the upper end 31 of the first arm 32 is further comprised of a first retainer aperture 34 and a first number of bracket serrations 33. The first retainer aperture 34 being a hole or opening that runs through the first arm 32 and aligns with the female threaded end 52 of the first insert 51. The first number of bracket serrations 33 are a set of indentations or notches that run radially out from the first retainer aperture 34. In the same manner the upper end 31 of the second arm 35 is further comprised of a second retainer aperture 37 and a second number of bracket serrations 36. The mounting knuckle 43 is further comprised of a first retainer screw 61 and a second retainer screw 62. In the preferred embodiment, the first and second retainer screws being a threaded bolt or other threaded fastener.

When attaching the pivoting bracket 30 to the mounting knuckle 43, the first retainer aperture 34 is aligned with the female threaded end 52 of the first insert 51. The first retainer screw 61 is inserted through the first retainer aperture 34 and threaded into the female thread end 52 of the first insert 51. The first number of bracket serrations 33 and the first number of insert serrations 55 are in contact with each other in this configuration. The bracket serrations and the insert serrations have a pattern that is capable of mating or interlocking with each other. With the first retainer screw 61 loose or not tightened down, the bracket serrations and the insert serrations are able to be separated and the rotational orientations of the first insert 51 and the pivoting bracket 30 can be adjusted. When the first insert 51 and the pivoting bracket 30 are in the user's desired rotational orientation, the first retainer screw 61 is then tightened, the first bracket serrations 33 and first insert serrations 55 are pressed together and interlock, and the pivoting bracket 30 is rotatably fixed with the first insert 51. In this same manner the second insert 56 is configured, adjusted and locked in place utilizing the second bracket serrations 36, the second insert serrations 60, the second retainer aperture 37, and the second retainer screw 62.

The mounting knuckle 43 is further comprised of a set screw 63 and a set screw aperture 64. The set screw 63 being a device that is positioned inside of a set screw aperture 64 and protrudes or extends out from the set screw aperture 64. The distance the set screw 63 extends from the set screw aperture 64 and thereby the mounting knuckle 43 is adjustable by means such as threaded adjustments. In the preferred embodiment, the set screw 63 is adjusted so the motor assembly 10 impinges of rests against the set screw 63 when the motor 19 is activated. This transfers the motor's 19 force directing into the mounting knuckle 43 and thereby directly into the stern of the kayak or watercraft, thereby reducing strain on the other components of the present invention.

The motor controller system 65 of the present invention provides the power needed to run the motor 19. Further the motor controller system 65 allows the user to control the motor 19. In a preferred embodiment of the present invention, the motor controller system 65 further comprises a motor controller 66, a remote control 68, an energy storage device 71, a sealed inlet port 69, and a motor wire 70.

In the preferred embodiment, the motor wire 70 is electrically and communicatively linked to the motor 19 within the motor assembly 10. The motor wire 70 runs out of the motor assembly 10 through the sealed inlet port 69. The sealed inlet port 69 being a waterproof seal that allows the motor wire 70 to exit the motor assembly in a waterproof manner. In the preferred embodiment, the motor wire 70 runs into the kayak or watercraft into a watertight area above the water line to keep the components dry. Other arrangements can be used in further embodiments, such as have some or all of the motor controller system 65 within the motor assembly 10.

The motor wire 70 is connected to the motor controller 66, which is a device which through the communicative link is able to control the speed and state of the motor 19. Further, through the electrical link, the motor controller 66 sends energy to the motor 19. The motor controller 66 is connected to the energy storage device 71 which provide energy. The energy storage device 71 can take many forms such as lithium-ion or other types of batteries, solar cells, fuel cells, wind generators, or fossil fuel generators.

The remote control 68 is a device which is communicatively linked to the motor controller 66 and allows the user to communicate with the motor controller 66. This remote control 68 can take many forms such as but not limited to a wired control pad or a wireless controller. The remote control 68 enables the user to remotely communicate to the motor controller 66 functions such as turning the motor 19 on or off, and desired motor 19 rotational speed.

The present invention has been explained as a preferred embodiment, but this does not limit the present invention. Further embodiments of the present invention can take many forms, including have a top protrusion 14 on the motor assembly 10. This top protrusion 14 is further comprised of a lift cord eyelet 16 which allows a lift cord to the attached. By pulling the lift cord, the user is able to lift and hold the motor assembly 10 out of the water.

Further, the present invention can be constructed using varied means. In some embodiments, the present invention may be constructed of varied materials such as steel or aluminum, composites, polymers, urethanes, and other materials suited for the water environment.

The present invention has been designed to allow the user the ability to set and control the position and orientation of the motor assembly 10. In the preferred embodiment, the straight slots 39 and the curved slots 40 are designed so that when the motor assembly 10 is raised, the propeller 21 points upwards in a substantially vertical position. As the motor assembly 10 is lowered, the motor assembly 10 is held in a substantially horizontal position, with the propeller 21 points along the length of the kayak or watercraft. This allows the motor assembly 10 to be properly positioned to propel the kayak or watercraft in a lower position. When the motor 19 is not in use, it can be lift up and behind the keel or out of the water to reduce drag.

The motor assembly 10 may be lifted out of the water using a lift cord. Further, the buoyant nature of the motor assembly 10 will automatically lift and float the motor assembly 10 up when the motor 19 is not activated. If the motor 19 is then subsequently activated, the motor assembly 10 will automatically lower itself into the water, due to the forward thrust of the motor 19. Further, since the motor assembly 10 is able to be lifted even when the motor 19 is activated, if the motor assembly 10 hits an obstruction while under power, the motor assembly 10 is able to be bumped or lifted up and backwards, minimizing the chances of damage.

The position of the motor assembly 10 in the lower position may be adjusted through several methods. The first method is that the lift cord may be used to constrain how low the motor assembly 10 is able to be lowered into the water. For the second method the user can adjust the lowest motor assembly 10 position by limiting the pivoting bracket 30 travel. Since, the first and second inserts have a rotational travel that is constrained by the first and second protrusions inside the first and second guide channels. Further, since the pivoting bracket 30 may be adjusted and then rotationally fixed to the first and second insert via the insert and bracket serrations, the pivoting bracket 30 can be adjusted so the first and second protrusions stop the pivoting bracket 30 at a lowest desired point. Other embodiments and methods may be utilized with the present invention such as shims, actuators, or integrally molded extensions.

In the preferred embodiment of the present invention, the motor assembly 10 has three preferred positions. An upright position, where the motor assembly 10 is lifted out of the water via a lift cord, or the buoyant nature of the motor assembly 10 floats and raises the motor assembly 10 up and behind the stern. A shallow running position where the motor assembly 10 is lowered and the propeller 21 is in line with the length of the kayak or watercraft. In this shallow running position, the motor assembly 10 is still substantially above the keel or bottom of the boat. This position is desired traveling in shallow water such as a creek of stream. The last position is a deep water position where the motor assembly 10 is fully lowered. In this position, the motor assembly 10 is substantially below the keel or bottom of the kayak or watercraft. This is the preferred position when running in deeper water, where a user is less likely to hit an obstruction.

When the user has mounted and adjusted the present invention, it is best practice to adjust the set screw 63 to ensure the set screw 63 impinge upon the motor assembly 10 during the activated or lowered position. When the motor assembly 10 is in a shallow water position, the set screw 63 is designed to impinge upon the front or lead end of the motor assembly 10. When the motor assembly 10 is in a deep water position, the set screw 63 is designed to impinge upon the rear surface 15 of the top protrusion 14 on the motor assembly 10.

Although the invention has been explained in relation to its preferred embodiment, it is to be understood that many other possible modifications and variations can be made without departing from the spirit and scope of the invention.

What is claimed is:

1. A kayak mounted motor apparatus adapted to propel a kayak, comprising:

a set of mounting plates;

a mounting knuckle;

one or more pivoting brackets;

a motor assembly;

the set of mounting plates being attached to the kayak;

the set of mounting plates being pivotally connected to the mounting knuckle;

the one or more pivoting brackets having an upper end and a lower end, wherein the lower end of the one or more pivoting brackets further comprises one or more straight slots and one or more curved slots and the upper end of the one or more pivoting brackets being pivotally connected to the mounting knuckle; and the motor assembly being rotatably connected to the lower end of the one or more pivoting brackets.

2. The apparatus as claimed in claim 1, wherein the motor assembly further comprises:

a first number of pins;

a second number of pins;

the first number of pins being slidably connected within the one or more straight slots; and the second number of pins being slidably connected within the one or more curved slots.

3. The apparatus as claimed in claim 2, comprising a bracket radius created by the one or more pivoting brackets rotating about the mounting knuckle;

a curved slot radius defined by the shape of the one or more curved slots; and the curved slot radius is inverted compared to the bracket radius.

4. The apparatus as claimed in claim 1, wherein the mounting knuckle further comprises:

a set of mounting knuckle hinges;

a set of hinge pins;

the set of mounting plates further comprises a set of mounting plate hinges; and the set of mounting plate hinges being removably connected and pivotably connected to the mounting knuckle hinges via the set of hinge pins.

5. The apparatus as claimed in claim 1, wherein the mounting knuckle further comprises:

a mounting bore;

a first insert;

a second insert;

the mounting bore having a first side and a second side;

the first insert having a female thread end and an interlocking end; the second insert having a female thread end and an interlocking end; the first insert being inserted into the first side of the mounting bore;

the second insert being inserted into the second side of the mounting bore; and the interlocking end of the first insert being connected and rotatably fixed with the interlocking end of the second insert.

6. The apparatus as claimed in claim 5, wherein the mounting bore further comprises a first guide channel;

the first insert further comprises a first protrusion;

the first protrusion traveling within the first guide channel; and the rotational travel of the first insert being constrained by the first protrusion within the first channel.

7. The apparatus as claimed in claim 6, wherein the mounting bore further comprises a second guide channel;

the second insert further comprises a second protrusion;

the second protrusion traveling within the second guide channel; and the rotational travel of the second insert being constrained by the second protrusion within the second channel.

8. The apparatus as claimed in claim 6, wherein the upper end of the one or more pivoting brackets further comprises a first arm;

the first arm further comprises a first number of bracket serrations and a first retainer aperture;

the female threaded end of the first insert further comprises a first number of insert serrations;

the mounting knuckle further comprises a first retainer screw;

the first retainer screw being inserted through the first retainer aperture and being threaded into the female threaded end of the first insert; and the first number of bracket serrations being connected and rotatably fixed with the first number of insert serrations.

9. The apparatus as claimed in claim 8, wherein the upper end of the one or more pivoting brackets further comprises a second arm;

the second arm further comprises a second number of bracket serrations and a second retainer aperture;

the female threaded end of the second insert further comprises a second number of insert serrations;

the mounting knuckle further comprises a second retainer screw; the second retainer screw being inserted through the second retainer aperture and being threaded into the female threaded end of the second insert; and the second number of bracket serrations being connected and rotatably fixed with the second number of insert serrations.

10. The apparatus as claimed in claim 1, wherein the mounting knuckle further comprises a set screw and a set screw aperture; and the set screw being adjustably positioned within the set screw aperture.

11. The apparatus as claimed in claim 1, wherein the motor assembly further comprises:

a housing body;

an end cap;

a motor;

a propeller;

the housing body further comprises a motor cavity;

the motor being mounted within the motor cavity;

the end cap enclosing the motor cavity;

the propeller further comprises a propeller shaft;

the end cap further comprises a propeller shaft aperture;

the propeller shaft traveling through the propeller shaft aperture; and the propeller shaft being connected to the motor.

12. The apparatus as claimed in claim 1, wherein a density of the motor assembly that is less than a density of water.

13. The apparatus as claimed in claim 1, wherein a motor controller system.

14. The apparatus as claimed in claim 13 wherein the motor controller system further comprises:

a motor controller; a remote control;

an energy storage device;

a motor wire;

the motor being electrically connected to the motor wire;

the motor wire being electrically connected to the motor controller; the motor controller being electrically connected to the energy storage device; and the remote control being communicatively linked to the motor controller.

15. The apparatus as claimed in claim 14, wherein the remote control is wireless.

* * * * *